United States Patent [19]

Spoon

[11] 4,309,038

[45] Jan. 5, 1982

[54] THROW TOY

[76] Inventor: Donald M. Spoon, 7912 Roswell Dr., Falls Church, Va. 22043

[21] Appl. No.: 119,567

[22] Filed: Feb. 7, 1980

[51] Int. Cl.[3] ..... A63B 65/00; A63H 3/00

[52] U.S. Cl. ..... 273/428; 46/151; 273/146

[58] Field of Search ..... 273/428, 146, 426, 425, 273/424; 46/29, 115, 151, 156, 22

[56] References Cited

U.S. PATENT DOCUMENTS

| | | | |
|---|---|---|---|
| 1,030,554 | 6/1912 | Wharton | 273/146 X |
| 2,187,493 | 1/1940 | Gordon | 273/428 X |
| 2,640,699 | 6/1953 | Garbo | 273/424 |
| 2,962,820 | 12/1960 | Petersen | 46/29 X |
| 3,868,115 | 2/1975 | Faiferlick | 273/146 |

FOREIGN PATENT DOCUMENTS

| | | | |
|---|---|---|---|
| 735649 | 6/1966 | Canada | 273/426 |

OTHER PUBLICATIONS

Morrison & Boyd, Organic Chemistry, Second Edition, 1969.

*Primary Examiner*—Paul E. Shapiro

*Attorney, Agent, or Firm*—Shlesinger, Arkwright, Garvey & Dinsmore

[57] ABSTRACT

A throw toy has spoke-like graspable members of differing lengths which extend from a central hub at approximately the same angle with respect to each other and have bulbous ends such that the toy is balanced for throwing and is readily catchable. The hub and the spoke-like members may represent the head of an animal-like figure.

16 Claims, 4 Drawing Figures

THROW TOY

BACKGROUND OF INVENTION

This invention relates to throw toys made of various types of soft material and which are thrown back and forth between game participants, and particularly to those types which have protruding grasping elements.

One of the more well-known marketed throw toys of this type has been a device whih has a large circular central section and six regularly spaced protruding grasping elements of equal length protruding therefrom. Because of this it is difficult to either throw or catch this toy. Further, there was a lack of throw balance in the device which made it harder to throw and catch and did not give the off-center weight distribution which can impart better conditions for control.

The Gordon U.S. pat. No. 2,187,493 provides a device which has a plurality of spokes or arms emanating from a central section and which are disposed in a common plane and an enlarged protuberance is provided at the end of the device to assist in catching the toy. It is thrown from person-to person with the object of catching the arm having the highest score value. The arms have different colored ends signifying different score values.

the Baier U.S. Pat. No. 3,892,406 discloses in FIG. 3 a throw toy wich has arms with an enlarged protuberance at the end thereof.

These devices have drawbacks in that they are not either readily throwable or catchable, nor do they provide a specifically designed toy balance for enchancing both throwing and catching. Also there is not the ability to vary the degree of difficulty for catching of the object by readily changing the manner in which the toy can be thrown. As a result of these drawbacks, the throw toys previously available have not become popular.

SUMMARY AND FEATURES OF INVENTION

Accordingly, this invention is related to improvements in pre-existing throw toy devices which have protrusions or spoke-like members.

It is a feature of this invention to provide a throw toy which can be readily thrown, and which can be caught with varying degrees of difficulty.

It is a further object of this invention to provide a throw toy which has balance which will permit control of the orientation, tumbling or spinning motion of the toy during the course of its thrown trajectory.

It is another feature of this invention to provide a throw toy which provides a multiple choice of catchable options and point values which can readily be seen during the course of flight of the toy, and allows one to readily elect the type of catch to be attempted.

A still further feature of the invention is the limitation of spoke-like members projecting from the central body of the toy to four in number and which are of differing length so as to provide both balance and various catchable options.

A still further feature of the invention is to provide a throw toy which has enlarged bulbous ends on the spoke-like members to enhance catchability of the toy and also to substantially reduce the possibility of facial injury should the toy strike the person attempting to catch it.

Another feature of this invention is the providing of a toy in the form of an animal-like head which adds interest and prominence to the several spoke-like members by which it is to be caught.

A further object of the invention is the provision of a stiffened and reinforced or spoke-like member which enhances the ability to throw the toy longer distances and to impart different types of motion to it during the course of its flight.

These and other features of this invention will be apparent from the following description and claims.

DESCRIPTION OF INVENTION

Figure 1:
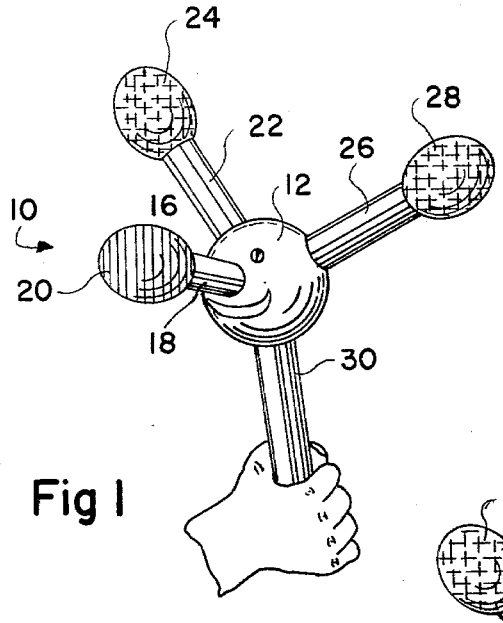
FIG. 1 discloses the throw toy held by the longer spoke-like member in a position for throwing.

Referring to the drawings, FIG. 1 discloses a perspective view of the throw toy held in a game participant's hand prior to throwing.

The throw toy generally designated at 10 has a central generally spherical hub 12 having a mouth 14 and eyes 16 which are disposed adjacent a spoke-like member 18. The spoke-like member is of short length and has a bulbous element 20 at its free end which is of sufficient size to fit into the palm of the hand to provide for ready. This member extends outwardly from the hub between the mouth 14 and the eyes 16 to represent the nose of the toy animal.

The spoke-like protrusion 22 is of similar construction to spoke-like member 18 and is supported by and integral with the hub member 12, has the diameter of member 18 and is approximately twice its length. It has a bulbous somewhat egg-shaped member 24 on the end thereof which is the same shape and size as member 20. All of these members have soft yieldable resilient surfaces to preclude injury to a player if one member happens to strike a participant.

A similar protruding member 26 of equal length to member 22 and having a corresponding bublous resilient end member extends outwardly from the head-like hub 12 on the side opposite from that of spoke-like member 22. Spoke-like members 22 and 26 represent the ears of the animal-like figure.

The lower piece 30 is approximately three times the length of member 18 and represents the neck of the animal configured throw toy. It is of generally the same construction and diameter of members 18, 22 and 26. It has a bulbous somewhat egg-shaped member 32 at the free end thereof for grasping (FIG. 2).

Figure 2:
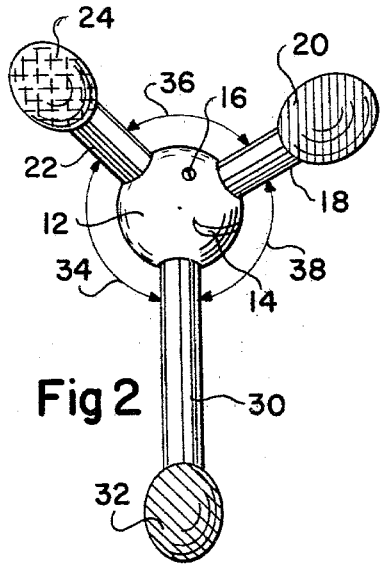
FIG. 2 is a side view of the throw toy of FIG. 1.

FIG. 2 is a side view of the throw toy which discloses the angular disposition of the spoke-like or protrusion members with respect to each other. The spoke-like members 22 and 32 are disposed at an angle 34 with respect to each other of approximately 120°. Similarly, spoke-like member 22 representing the ear of the animal-like head is disposed at an angle 36 of approximately 120° with respect to the nose-like projection spoke-like member 18. The spoke-like member 18 is disposed at an angle 38 of approximately 120° with respect to the spoke-like member 30 representing the animal-like throat. The angular orientation of all of the spoke-like members of approximately 120° with respect to each other provides balance and symmetry for the toy.

Figure 3:
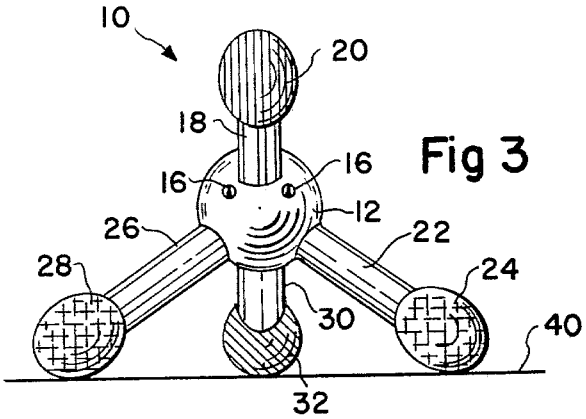
FIG. 3 is an end view of the toy as it rests on a flat surface.
Figure 4:
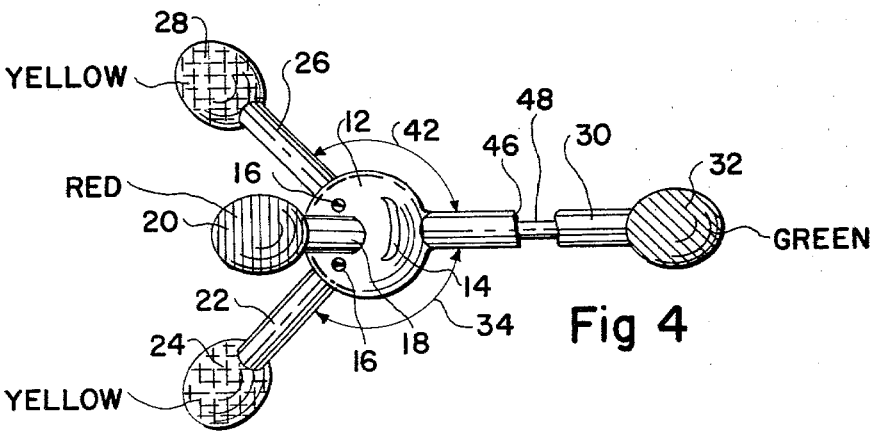
FIG. 4 is a top view looking down on the throw toy of the instant invention as it rests on a flat surface.

In FIG. 3 the throw toy 10 is shown on a flat surface 40 with the bulbous ends 24, 28 and 32 of their spoke-like protrusions resting thereon in a triangular fashion. A top view of FIG. 3 is shown in FIG. 4. It can be seen that the angles between spoke members are equal in this view also. Spoke-like members 26 and 30 have an angle 42 of approximately 120° and it is similar to angle 34 on the other side as discussed above with respect to FIG. 1. The angular disposition between the two spoke-like members 22 and 26 is also approximately 120°.

In FIG. 4 the interior construction of the spoke-like members is shown. It is typical for all of such members. The cut-away section of spoke-like member 30 is cut away at 46 through the resilient padding of sponge or rubber-like material to reveal the central stiffening member 48. This stiffening member may be made of wood, plastic or metal and is integrally fixed to the hub, and is surrounded by soft resilient material. The stiffening member 48 provides the necessary rigidity for the spoke-like members so that the toy can be readily thrown and caught over longer distances than otherwise, making it possible for use on a large playing field.

For use at shorter distances, or in the home, or at the beach, where it may be desired to have a softer or lighter toy of generally similar configuration, the toy may be hollow and have a thin resilient outer skin made of rubber or plastic. This type of unit could be either inflated at the factory and sealed, or provision could be made for the toy to be of inflatable construction with an air valve.

It is also possible to make the unit of solid light foam or rubber material. In either of these instances, the weight of the toy would be such that it could be readily thrown.

OPERATION

The toy is held in the hand by one of the bulbous members of the spoke-like members, preferably member 32 and then thrown a distance to the other participant in the game who has to catch it.

FIG. 1 shows a preferred method of holding the toy for throwing, with the person grasping the longest spoke-like member. It is tossed, in whatever manner preferred, imparting an upright, spinning, or tumbling motion as desired, or a combination of each of these motions. It is used in a point scoring, catching game in which points are scored by the manner of catching the toy. The person attempting to catch the toy has the option of grasping either the longer or shorter spoke-like members, or the central hub itself. The shorter members have a higher point value than longer spoke-like members. The hub has a lower point value than all of the spoke-like members. It will be noted that the bulbous members are color coded for assisting in making distinction during the course of flight of one spoke-like member from another.

In addition to its use as a catching game between individuals, it can be used as a team game in which the toy is used somewhat like a football. In this instance, it can be either thrown, handed off, or kicked, in much the same fashion as a football.

One important aspect of the construction of the toy is that it will not keep moving after it strikes the ground, as would a ball or similar type of object. The four substantially equi-angular projecting legs provide a tripod type of support for the toy in all directions. The ends of the spoke-like members locate the points of a tetrahedron, the sides of which are planes defined by each end and those of the two adjacent ends of spoke-like members.

Because of this tripod effect, the toy can safely be used on lawns adjacent streets, because it will not roll or bounce from the lawn into the street as would a ball.

Further, from the safety standpoint, because of the angularly projecting spoke-like members and the weight distribution of the toy behind it, it is only possible to obtain a glancing blow should it strike one of the players. In this way there is no direct impact with the weight of the toy behind it, since on contact the toy, due to the weight distribution, will spin off the object or person it hits, imparting less contact force than would otherwise be sustained.

While this invention has been described, it will be understood that it is capable of further modification, and this application is intended to cover any variations, uses, or adaptations of the invention following, in general, the principles of the invention and including such departures from the present disclosure as come within known or customary practice in the art to which the invention pertains, and as may be applied to the essential features hereinbefore set forth and fall within the scope of the invention or the limits of the appended claims.

I claim:

1. A throw toy, consisting of:
(a) a generally spherical central hub having a relatively soft surface,
(b) four outwardly projecting spoke-like hand-graspable members integral with and diverging outwardly from the hub in different directions,
(c) two spoke-like members being of intermediate length, one spoke-like member being of a short length, and one spoke-like member being of a long length,
(d) the spoke-like hand-graspable members including at their ends a bulbous member smaller in size than the central hub which will readily fit into the palm of the hand and has a relatively soft outer surface,
(e) the two intermediate length spoke-like members extending generally in the same direction, and the long spoke-like hand-graspable member extending generally in the opposite direction,
(f) the short spoke-like member extending generally outwardly and away from a plane defined by the periphery of the bulbous member at the ends of the three other spoke-like members, and
(g) the spoke-like members being relatively stiff unbending members.

2. A throw toy, comprising:
(a) a generally spherical central hub having a relatively soft surface,
(b) four outwardly projecting spoke-like hand-graspable members integral with and diverging outwardly from the hub in different directions,
(c) two spoke-like members being of intermediate length, one spoke-like member being of a short length, and one spoke-like member being of a long length,
(d) the spoke-like hand-graspable members including at their ends a bulbous member smaller in size than the central hub which will readily fit into the palm of the hand and has a relatively soft outer surface,
(e) the two intermediate length spoke-like members extending generally in the same direction, and the long spoke-like hand-graspable member extending generally in the opposite direction, (f) the short spoke-like member extending generally outwardly and away from a plane defined by the periphery of the bulbous member at the ends of the three other spoke-like members, (g) the spoke-like members being relatively stiff unbending members, and (h) the spoke-like members being marked to indicate a point value depending upon their length with greater point values being assigned to the shorter spoke-like members and lesser point values being assigned to the longer spoke-like members.

3. The throw toy as set forth in claim 1 or 2, wherein:

(a) the bulbous member on the free end of the spoke-like graspable members is substantially egg-shaped to fit the palm of the hand.

4. The throw toy as set forth in claim 1 or 2, wherein:

(a) the central hub is approximately the size of a tennis ball.

5. The throw toy as set forth in claim 1 or 2, wherein:

(a) the spoke-like hand-graspable members are internally reinforced so that they are relatively stiff and unyieldable to resist bending.

6. The throw toy as set forth in claim 1 or 2, wherein:

(a) the overall appearance thereof gives the general impression of an animal head caricature, (b) the shorter spoke-like member represents the nose, the two intermediate length spoke-like members represent ears, the longest spoke-like member represents the neck area, and (c) two eyes are disposed on the hub between the spoke-like members representing the nose and ears, and a mouth is disposed on the other side of the spoke-like member representing the nose of the animal head caricature.

7. The throw toy as set forth in claim 6, wherein:

(a) the longest spoke-like member representing the neck of the animal is of sufficient length to be used as a handle for throwing the toy.

8. The throw toy as set forth in claim 1 or 2, wherein:

(a) the shortest spoke-like member is approximately one and a half times the diameter of the hub, the intermediate spoke-like member is twice the length of the shortest spoke-like member, and the longest spoke-like member is three times the length of the shortest spoke-like member.

9. The throw toy as set forth in claim 1 or 2, wherein:

(a) the bulbous elements on the ends of the spoke-like members are colored to designate different point values, with the color of the bulbous member on the smaller spoke-like member designating the highest point value, the color of the bulbous member on the intermediate spoke-like member designating an intermediate point value, and the color on the bulbous member of the longest spoke-like member designating the lowest point value.

10. A throw toy, comprising:

(a) a central hub having a relatively soft surface and including thereon facial indicia elements of an animal head, (b) a plurality of relatively stiff outwardly projecting spoke-like hand-graspable members disposed at different points on the hub and which have a relatively soft surface, (c) the spoke-like members being of nonuniform length, and being of such size and location with respect to the facial indicia to represent protuberances on the head whereby the toy gives the overall impression of the head of an animal.

11. The throw toy as set forth in claim 10, wherein:

(a) the hub and the spoke-like members have a soft resilient surface and each spoke-like member has a bulbous grasping element at its free end.

12. The throw toy as set forth in claim 10, wherein:

(a) there are four spoke-like hand-graspable members extending from the hub at an approximate angle of 120° with respect to each of the other three such members.

13. The throw toy as set forth in claim 10, wherein:

(a) the length of the shortest spoke-like member is slightly longer than the hub diameter, two intermediate length spoke-like members are approximately twice that length, and the longest spoke-like member is approximately three times the length of the shortest such member.

14. The throw toy as set forth in claim 10, wherein:

(a) the outwardly extending spoke-like hand-graspable members are of substantially equal diameter, and (b) there are four spoke-like hand-graspable members two of which are of intermediate length, one of a long length and one of short length, (c) the two intermediate length spoke-like members representing the ears of the animal and extending generally in the same direction, while the long spoke-like hand-graspable member represents the neck of the animal and extends generally in the opposite direction, and (d) the short spoke-like member representing the nose and extending generally outwardly and away from a plane defined by the outer tips of the other spoke-like members.

15. The throw toy as set forth in claim 10 or 14, wherein:

(a) the ends of the spoke-like hand-graspable members have a soft yieldable bulbous element of substantially egg-shaped configuration which readily fits into the palm of the hand.

16. The throw toy as set forth in claims 1, 2 or 10, wherein:

(a) the lengths of the spoke-like hand-graspable members are substantially greater than the diameter of the hub member so that on impact of one of the spoke-like members with an object, the throw toy has a tendency to glance off such object and change direction, rather than to continue on a direct path.

* * * * *